US006497230B1

(12) United States Patent
Higgins et al.

(10) Patent No.: US 6,497,230 B1
(45) Date of Patent: Dec. 24, 2002

(54) AIR PORT DAMPER

(75) Inventors: Daniel R. Higgins, Tigard, OR (US); Eugene Sullivan, Mobile, AL (US); Robert B. Hill, Beaverton, OR (US)

(73) Assignee: Anthony-Ross Company, Beaverton, OR (US)

( * ) Notice: Subject to any disclaimer, the term of this patent is extended or adjusted under 35 U.S.C. 154(b) by 0 days.

(21) Appl. No.: 09/545,682

(22) Filed: Apr. 7, 2000

Related U.S. Application Data

(60) Provisional application No. 60/128,633, filed on Apr. 9, 1999.

(51) Int. Cl.[7] ..... F23L 13/00; F23L 5/00

(52) U.S. Cl. ..... 126/285 R; 431/154; 431/12; 110/163; 110/182.5

(58) Field of Search ..... 126/285 R, 286, 126/77, 112, 290, 289, 291; 431/154, 155, 188, 186, 12, 8, 32; 122/6.6, 6.5, 379, 390; 110/182.5, 147, 158, 163, 175 A, 175 R, 297, 301, 309, 310, 313, 186, 188, 185; 15/246

(56) References Cited

U.S. PATENT DOCUMENTS

| | | | | | |
|---|---|---|---|---|---|
| 3,869,243 | A | * | 3/1975 | Creuz | 126/285 R |
| 4,099,471 | A | | 7/1978 | Sander et al. | 110/182.5 |
| 4,425,855 | A | * | 1/1984 | Chadshay | 110/265 |
| 4,838,182 | A | | 6/1989 | Goodspeed | 110/182.5 |
| 5,001,992 | A | | 3/1991 | Higgins et al. | 110/182.5 |
| 5,044,327 | A | | 9/1991 | Hunt | 431/188 |
| 5,167,192 | A | | 12/1992 | Pingel et al. | 110/182.5 |
| 5,351,631 | A | * | 10/1994 | Hill et al. | 110/182.5 |
| 5,662,464 | A | * | 9/1997 | LaRose et al. | 431/8 |
| 5,824,275 | A | | 10/1998 | Bitzer et al. | 110/182 |
| 6,024,028 | A | | 2/2000 | Simonen | 110/182.5 |
| 6,148,743 | A | * | 11/2000 | Vatsky | 110/297 |

FOREIGN PATENT DOCUMENTS

| | | | |
|---|---|---|---|
| GB | 2 168 472 A | * | 6/1986 |
| JP | 10-19246 A | * | 1/1998 |

* cited by examiner

*Primary Examiner*—Henry Bennett
*Assistant Examiner*—Josiah C. Cocks
(74) *Attorney, Agent, or Firm*—Dellett and Walters

(57) ABSTRACT

An air port damper system for a recovery boiler employs plural louvers for altering the exit angle of air through an air port. Dampers are provided to enable adjustment of the flow through the device. Suitably, the device may be retracted away from the air port, to enable manual or automatic cleaning of the port. Further the damper system can be removed for maintenance/service purposes, without requiring shut-down of the boiler.

25 Claims, 11 Drawing Sheets

AIR PORT DAMPER

BACKGROUND OF THE INVENTION

The present invention relates to a device for the regulation of air flow through secondary, tertiary, and quartenary combustion air ports of a chemical recovery boiler.

Pulp for papermaking is typically manufactured according to the Kraft process wherein wood chips are treated with a chemical cooking liquor. The wood chips and liquor are cooked in a digester under predetermined pressure and temperature conditions. At a subsequent point in the process, a "black liquor", comprising spent chemicals and organic material, is separated from the pulp and is processed in a chemical recovery boiler for reclaiming the cooking chemicals.

This "black liquor" is the fuel for the recovery boiler. It is spray injected into the firebox of the recovery boiler through several nozzles that are located several meters above the boiler floor. The "black liquor" is atomized during injection, dries and falls to the floor of the boiler, forming a mound called the char bed. The "black liquor" has both organic and inorganic constituents wherein the organic constituents burn at a high temperature, and the inorganic constituents are reduced within the char bed to a molten state. The inorganic constituents of the "black liquor" are the cooking chemicals that are being reclaimed. The char bed may exceed two meters in depth with its shape and size controlled by jets of combustion air flowing from the primary and secondary air ports. When the char bed grows in size so as to reach the elevation of the secondary ports, these air jets enhance the localized combustion and "burn back" that area of the char bed thus controlling the height and shape of the char bed. The tertiary and quartenary ports, if present, reside at a higher elevation, introduce the rest of the combustion air, and create turbulence to promote mixing, combustion and heat release in the boiler. Some older boilers have just primary and secondary air ports, wherein the secondary air ports correspond in location and function to the tertiary ports mentioned above.

The mass flow control of the combustion air through the ports is critical as it must be controlled to remain within certain stoichiometric parameters, as well as perform the functions discussed above. If not, the overall efficiency of the boiler decreases and mechanical problems abound. Since it is difficult to completely mix the fuel and combustion air, it is common practice to add more combustion air than required for stoichiometric conditions. This helps promote complete combustion. If too much air is admitted to the boiler, however, it will cause an excessive vertical gas flow in the boiler which entrains more particulates and pushes the heat release higher in the boiler causing increased fouling on heat exchanger components and decreased thermal efficiency. Since the air ports affect the lateral and vertical gas flows in the boiler, the location, quantity, and size of the air jets is a critical factor in their performance, in addition to the mass flow of air admitted. Herein lies the problem.

Some boilers have secondary ports that are positioned too high for optimal control of the bed height or are designed such that they require excessive air flow to accomplish this task. If the char bed gets too high it is hard to control and the core may be too cold to properly recover the inorganic constituent. It is also often the case that there are too many secondary ports and/or the ports may be too small. Conversely, many boilers have oversized secondary ports to take into account the fouling that causes a reduction to their opening size until they can be cleaned manually with steel rods. A further difficulty is that other boilers have poor tertiary or quartenary port performance wherein the air jets do not interact optimally with the gas flows and require excessive amounts of air to accomplish the mixing, combustion and heat release functions. A further disadvantage is that some boilers have air ports that do not allow the air to penetrate very far into the boiler, and therefore do not enhance combustion of the fuel. Finally, many newer boilers utilize an apparatus to regulate the air flow through the air ports, however this apparatus is generally structurally fixed to the air port, requires adjustment prior to cleaning of the airport, and is notoriously unreliable. The air ports in a boiler are fixed in location. Once they are made, they cannot be moved to accommodate changing needs or peculiarities of operational characteristics of a given boiler.

In the prior art, nozzles have been inserted into air ports, to provide a more concentrated air jet out of the port. However, adding the nozzles raises space considerations in the duct work around the ports. Reducing the free space around the port can affect the air flow characteristics in the ducts and makes installation of additional equipment problematic.

The above mentioned problems with the lackluster performance of the existing prior art air ports causes operational inefficiencies such as excessive down time, low quality inorganic constituent recovery, slow "black liquor" burn rates, excessive fouling on boiler surfaces, poor thermal efficiency and poor char bed control.

SUMMARY OF THE INVENTION

In accordance with the present invention, an air port damper is provided which is adapted to regulate the mass flow and direction of a combustion air jet stream into a boiler. It is an object of the present invention to alleviate the above problems by providing an apparatus and method to control the direction of the air jets as well as the mass flow through the ports. For example, if the secondary ports are located too high, the secondary air jets can be angled downward, such that they interact with the char bed at the optimal height.

In a preferred embodiment, the air port damper is an apparatus that contains a louvered system (for controlling the direction of the air jet through an air port), a damper system (for regulating the mass flow of air through an air port), and an mechanism for moving the air port damper apparatus into or away from its operational position.

It is accordingly an object of the present invention to provide an improved apparatus for adjusting the direction of a combustion air jet stream into a boiler.

It is another object of the present invention to provide an improved apparatus for regulating combustion air into a boiler.

It is a further object of the present invention to provide an improved tool that in effect allows a boiler operator to "move" the ports of the boiler by altering the air flow characteristics therethrough.

It is still another object of the present invention to provide a method of controlling the direction and flow of combustion air into a boiler through an air port that does not interfere with the on-line cleaning of the boiler.

It is yet a further object of the present invention to provide an improved method of controlling char bed height in a boiler.

It is still a further object of the present invention to provide an improved method for reducing internal boiler fouling.

It is another object of the present invention to provide an apparatus capable of separately regulating the mass air flow and adjusting the direction of air flow into a boiler through its existing air ports.

It is another object of the present invention to provide an improved apparatus capable of separately regulating the mass air flow and adjusting the direction of air flow into a boiler through its existing air ports, while working in conjunction with an automatic port cleaner.

It is another object of the present invention to provide an improved apparatus capable of separately regulating the mass air flow and adjusting the direction of air flow into a boiler through its existing air ports such that the total mass airflow required may be reduced.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present invention comprises an adjustable damper assembly that enables direction and volume adjustment of air flow through an air port, and which is capable of moving away from the port for cleaning of the port, and which is removable from the boiler for maintenance of the mechanism.

Figure 1:
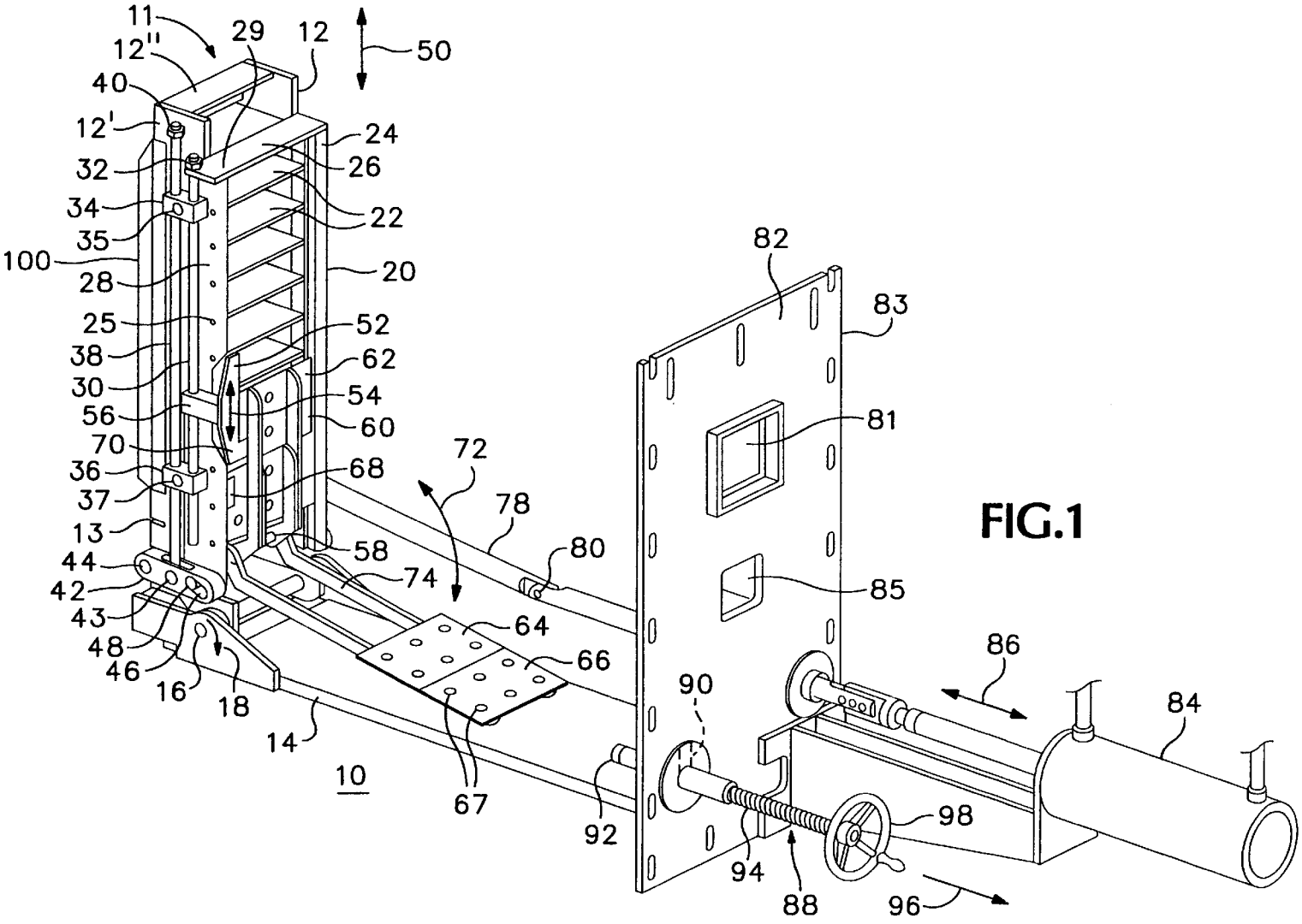
FIG. 1 is a perspective view of a first embodiment of the adjustable damper assembly according to the invention, with components of the installation environment removed for clarity, with the damper box in the extended position.

Referring now to FIG. 1, a perspective view of the adjustable damper assembly according to the invention, with components of the installation environment removed for clarity, the damper device 10 comprises a damper frame 11 consisting of right and left vertically aligned side members 12, 12', and top 12" and bottom (not visible) horizontally aligned members, defining a damper box 11. The damper box is pivotally mounted to a base assembly 14 by pivot pin 16, which enables pivotal movement of the damper box on arc 18 as discussed hereinbelow. Mounted at one face of the damper box is a damper louver frame 20, which carries plural damper louvers 22 mounted therein, in spaced relation to each other. The louvers are held within the louver frame via pins (not shown) that extend through the side walls via holes 25 at either side of the damper louver frame. The louvers extend forwardly to the front face (the face away from the view point in FIG. 1) of box frame 11, suitably being affixed to side members 12 and 12' near the front face of box frame 11 via pins (not visible in FIG. 1) which reside in horizontal slots 13. The proximal ends of the louvers are allowed to pivot on the pins engaged in holes 25, while the distal ends are allowed to translate in the slots 13. This motion enables adjustment thereof as discussed below. Top tie member 26 defines the top of the louver frame, and one side thereof extends beyond the edge of the louver frame side 28, defining an overhanging portion 29. An aperture in portion 29 receives a first screw 30 therethrough, and a nut 32 is secured on the top end of screw 30, such that rotation of the nut drives rotation of the screw. Screw 30 extends along a substantial portion of the long side of damper louver frame 20, is free to rotate without translational engagement with the aperture in portion 29, and includes a retaining ring (not visible) on the underside of portion 29, to maintain the positional relation of the screw and the louver frame 20. First and second retaining blocks 34 and 36 are positioned near top and bottom ends of the louver frame, and receive the screw 30 therethrough, serving to assist in maintaining the screw in position at the side of the frame, while still allowing free rotation of the screw 30 without translation thereof. The blocks 34 and 36 are secured to the damper frame side 12', suitably with bolts 35 and 37 (not shown), passing through slots in louver frame side 28. Positioned adjacent and parallel to screw 32 is a second screw 38, adjacent damper frame side 12', and engaging second apertures in blocks 34 and 36. A nut 40 is provided at the uppermost end of screw 38 and, corresponding to the relation of nut 32 and screw 30, nut 40 is secured to screw 38 such that rotation of the nut drives rotation of the screw. The engagement of screw 38 with blocks 34 and 36 is rotational but not translational. The translation of screw 38 relative to blocks 34 and 36 is prevented by retaining rings (not shown) affixed to screw 38, immediately above and below block 34.

The relation between box frame 11 and louver frame 20 is such that louver frame 20 is capable of sliding movement upwardly or downwardly relative to box frame 11, along the axis illustrated by arrow 50.

At the end of screw 38 distal from nut 40, at the bottom of box side frame 12', is an elongate member 42 receiving the screw 38 substantially centrally therein. Screw 38 threadably engages pin 43, inserted through member 42. At the left end (as viewed in FIG. 1) of member 42, a pivotal shaft 44 is provided that extends across the width of box frame 11. At the right end of member 42 is a slot 46, with a cam follower 48 riding therein. The other end of cam follower 48 is secured to louver frame side 28. Rotation of screw 40 causes pin 43 to translate along the screw, in turn causing rotation of member 42 about pivotal shaft 44. Rotation of member 42 drives cam follower 48 along a vertical path, raising or lowering louver frame side 28.

Pivotal shaft 44 transfers the rotational motion of member 42 to the opposite side of damper frame 12, where members identical to 42 and 48 are suitably engaged.

In spaced relation with screw 30, positioned between blocks 34 and 36, is a translatable slider member 52, held in position by arm 56 that threadably receives screw 30 therethrough. Slider 52 is adapted to translate, sliding along the rear face of louver frame 28 along axis 54. Slider 52 is "L-shaped" in cross section, defining a guide plate that rides along and holds the slider in alignment with the side of louver frame 28.

At the back face of louver frame 20, a damper pin 58 extends across the width of the frame, and provides pivotal mounting to first, second, third and fourth damper plates 60, 62, 64 and 66. A notch 68 is provided at one side of damper plate 60, and a correspondingly shaped tab portion 70 is defined on slider member 52. Each of the damper plates is attached to pivotally move on arc 72, centered on damper pin 58, via damper plate arms 74, successive damper arms being longer so as to place the respective damper plate against a different portion of the louver frame when rotated to a leftmost position. Arms 74 are nested, such that the shortest arm set is most centrally located relative to the louver frame sides, while successive arms are positioned outwardly therefrom. Each damper plate has plural through vent holes 67 in the face of the plate, suitably providing about a 5% flow through the plate when the plate is in the closed position.

A push rod 78, which may include joint 80 approximately at the center of the extent of the rod, attaches to a front edge of box frame 12, near the lower end thereof, but above the position of pivotal shaft 44. A distance away from the box frame and louver frame, push rod 78 passes through a wind box seal plate 82 and is engaged by a pneumatic cylinder 84 mounted on the outside (relative to the wind box) of wind box seal plate 82 and which extends and retracts along the axis of arrow 86.

To the left of cylinder 84 is provided a rotational shaft 88, which extends from the outside of the wind box seal plate through a slot 90, which is elongate in the vertical axis, approximately 1 inch length in the illustrated embodiment. On the inside of the wind box seal, at the end of shaft 88, is a driving socket 92, suitably having a size corresponding to that of nuts 32 and 40. A spring 94 is provided on shaft 88, on the outside of the wind box seal, to urge the shaft 88 outwardly in the direction of arrow 96. A rotational handle 98 is suitably provided on the outside end of shaft 88.

Mounted at the left and right sides of box frame 11 near the front face thereof are flanges 100, which are provided to seal the front face of the box frame against corresponding portions of an air port, against which the apparatus 10 is to be mounted.

In operation, the louvers and damper plates are suitably adjusted, so as to provide directional and volume control to enhance the operation of the boiler and to control the char bed as desired. In the preferred embodiment, the horizontal louvers enable adjustment of the air flow in the vertical direction. Typical adjustment ranges through which the air flow would be adjusted are from horizontal to approximately 30 degrees downward. Adjustment of the device is accomplished by operation of cylinder 84, which will retract rearwardly along axis 86, pulling shaft 78 backward, thereby causing the box frame (and the louver frame) to pivot backwardly about shaft 16, so as to be substantially horizontal. With the frame in this horizontal configuration, both nuts 32 and 40 are positioned near driving socket 92. An operator suitably adjusts the degree of tilt of the lovers, by sliding the shaft 88 upwardly a bit in slot 90, and engaging socket 92 with nut 40, and rotating the handle 98. This rotation causes screw 38 to rotate, which translates pin 43 along its length, which in turn, rotates member 42, in turn driving cam follower 48 and, by virtue of attachment of cam follower 48 to the louver frame 28, results in translation of the louver frame relative to the box frame. The opposite louver frame 24 is similarly driven via pivotal shaft 44. Since one edge of the louvers is hooked to the box frame and the other is hooked to the louver frame, the degree of tilt of the louvers is thereby adjusted. Once the frame is tilted back up, by operation of cylinder 84 in the extend direction, the air flow from the wind box will be directed through the louvers into the air port. The louvers thereby provide directional control to the air jet.

To control the volume of air going through the port, with the box frame in the horizontal position (FIG. 4), the shaft 88 is pushed inwardly so that socket 92 engages nut 32, and handle 98 is rotated. This rotation causes screw 30 to turn, which results in the translation of slider member 52 along the screw. With slider member 52 in its lowermost position, tab portion 70 is aligned with notch 68. Then, when the louvers are moved back to the upright position of FIG. 1, none of the damper plates 60, 62, 64 or 66 are held against the back of the louvers, allowing maximum air flow through the louvers. Successive translation of the slider member along screw 30, will result in the tab portion 70 of the slider engaging with the back face of successive ones of the damper plates, so that when the louvers are pivoted back to the upright position, one or more of the damper plates (as dictated by the position of the slider) are "picked up" with the louver frame and box frame, blocking the respective louvers. The nested arrangement of the damper plates enables a selected damper and all those dampers below the selected damper to be picked up, while damper plates higher up will be left in the down position. In FIG. 1, damper plates 64 and 68 are in the "down" position, while damper plates 60 and 62 are picked up. The tab portion 70 of slider member 52 is engaged with damper plate 62. The placement of vent holes 67 in the damper plates ensures that a minimal amount of air continues to flow through the damper plate and through the corresponding louvers, even when the damper plate is closed, providing a cooling effect to the dampers and the louvers (since the device is operating at the opening of the furnace, which is a high temperature environment). Also, the vent air that continues to flow through the louvers keeps entrained material from within the recovery furnace from collecting in the blocked louver spaces, which could result if air flow was completely shut off, as a result of, for example, recirculation currents produced by the air jet from the air port.

Since the device is mounted on base assembly 14, it may be easily removed and replaced, for repair or maintenance. The wind box seal 82 is merely unbolted (or otherwise detached) from the wind box, and the device may be slid out as a single unit. Suitably, the plural slots 83 formed about the periphery of the windbox seal are to receive bolts therethrough, or other suitable fasteners, to enable attachment and detachment of the device to the windbox. A viewing window 81 and a manual port cleaning access door 85 may also be provided.

Figure 2:
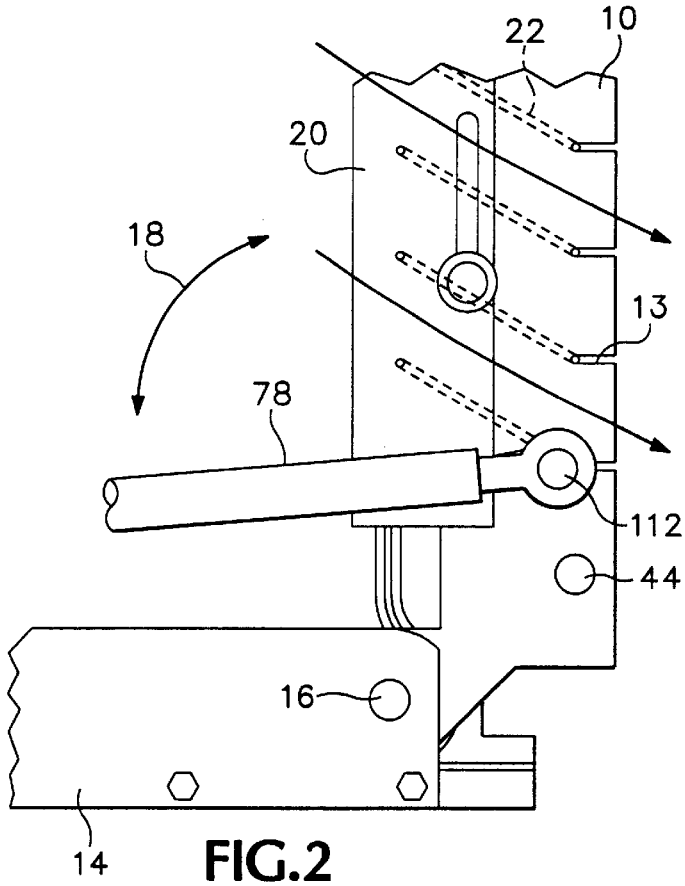
FIG. 2 is a side partial view of the louver portion of the device of FIG. 1, as viewed from the opposite side of the view of FIG. 1.

Referring now to FIG. 2, a side partial view of the louver portion of the device, as viewed from the opposite side of the view of FIG. 1, the attachment of push rod 78 to the damper frame 10 may be observed. Rod 78 is pivotally mounted at pin 112 near the forward edge of the damper frame.

Accordingly, when rod 78 (which is in the extended position in FIG. 2) is retracted by operation of cylinder 84, the louver frame 10 will pivot backwardly along arc 18. Adjustment of the louvers and dampers is then possible as discussed hereinabove. It will be observed in FIG. 2 that the louver blades are tilted substantially forwardly, thereby directing airflow downwardly, while in FIG. 1, the louver blades are essentially horizontal, resulting in a horizontal air flow through the device.

Figure 3:
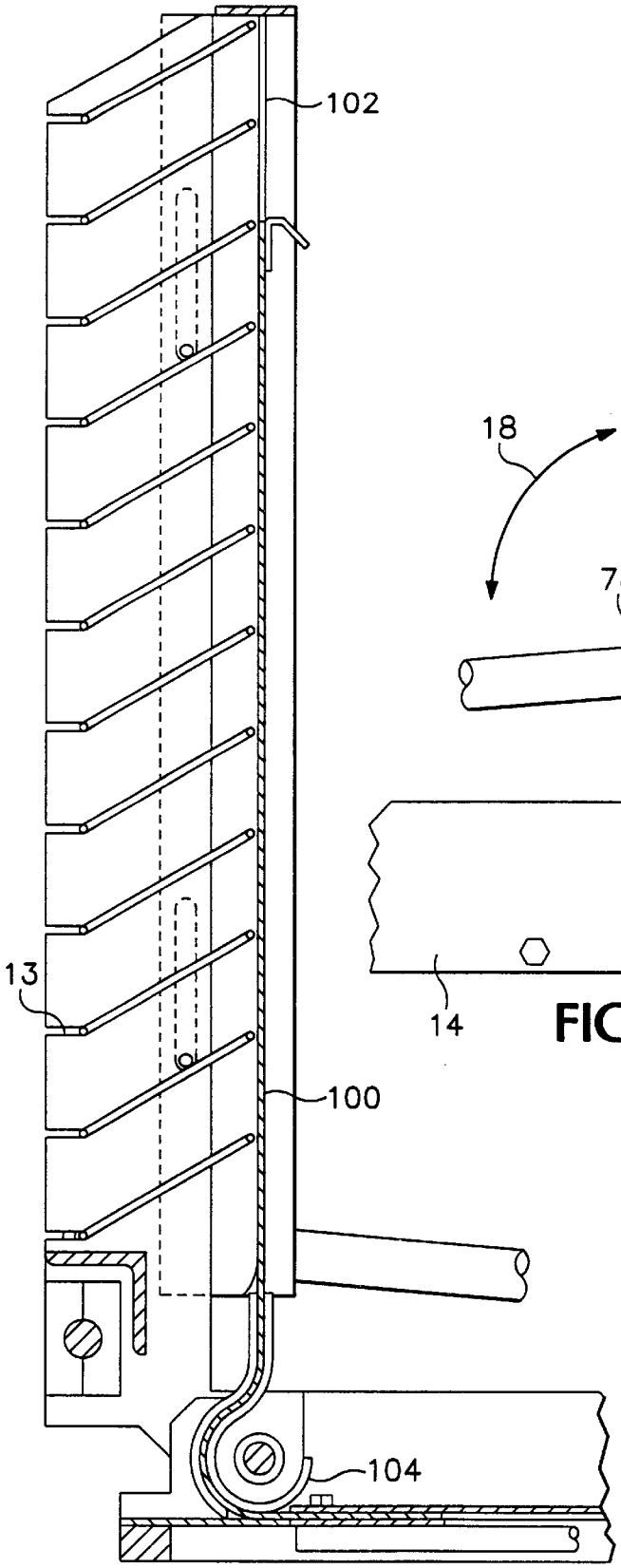
FIG. 3 is a side sectional view of a louver frame with an alternative damper structure.

Referring to FIG. 3, a side sectional view of a louver frame with an alternative damper structure, a flexible sheet member 100 is suspended at the rear of the louver frame within slots 102, which suitably extend on inner sides of the louver frame to define travel slots. The sheet 100 loops down over a guide or roller 104 at the bottom of the louver frame and extends back towards the rear of the device, suitably being received by a take up roll or slide mechanism. In operation, by adjusting the vertical extent of withdrawal of the sheet from its take up roll, the amount of damper effect can be increased or reduced. Suitable materials for the damper roll comprise stainless steel sheet, a stainless steel mesh screen, synthetic resin polymer (such as Teflon brand) coated fiberglass, for example.

Figure 4:
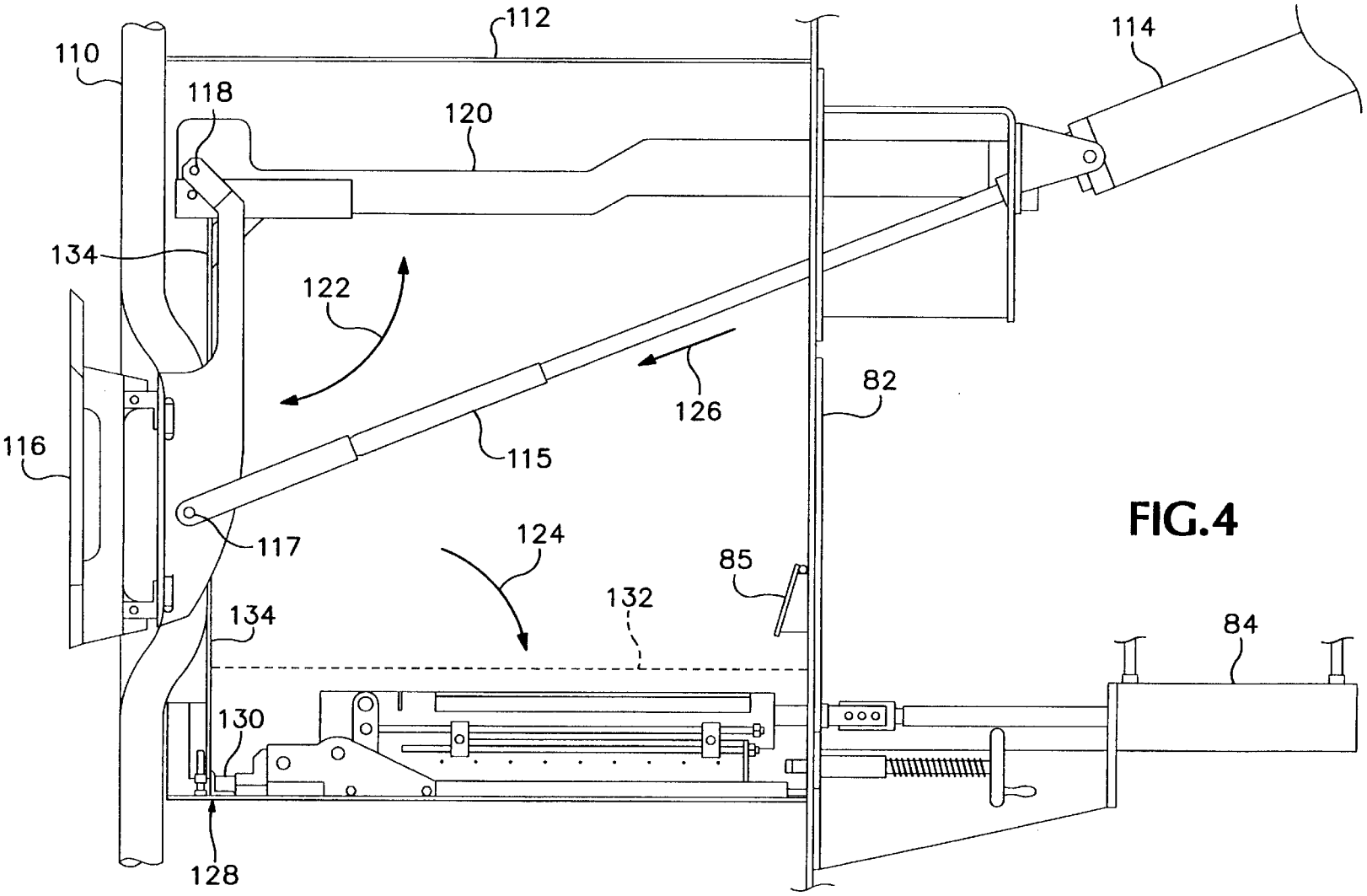
FIG. 4 is a partial side environmental view of the adjustable damper assembly of FIG. 1 in its retracted position, with a port cleaner device in a cleaning cycle.

Referring now to FIG. 4, a partial side environmental view of the adjustable damper assembly in its retracted position, with a port cleaner device in a cleaning cycle, the furnace wall is defined by cooling tubes 110, some of which are bent to define air ports into the furnace. A wind box 112 defines a pressurized space outside of the air port, to force air into the furnace through the port. A port plate 134 is secured in position at the port, and is mounted within the windbox, providing a precisely located (relative to the port) attachment point for other apparatus. Mounted above the windbox seal plate 82 is a pneumatic ram 114 which is in driving engagement with air port cleaner 116 via drive rod 115 attached to port cleaner 116 at pivot pin 117. Cleaner 116 is pivotally mounted by pin 118 to a support beam 120, to enable swinging movement of the cleaner in an arc about pin 118 as indicated by arc 122. The support beam attaches to the port plate 134 so that the cleaner is properly aligned relative to the port to be cleaned. Accordingly, when a cleaning operation is to be performed, cylinder 84 is retracted, which pulls the air port damper down in the direction of arc 124. Now, with the damper assembly out of the way, ram 114 is actuated to drive the drive rod 115 in the direction of arrow 126, causing the port cleaner 116 to swing down into and through the port. Any built up material around the port opening is thereby broken free and pushed into the furnace interior, opening up the port for maximal air flow. Then, the ram 114 is retracted, and the port cleaner swings back up to a rest position, out of the way so that the damper assembly can be swung back upwardly to be in engagement with the port. Accordingly, the air port can still be cleaned as needed, while still enjoying the use of the damper assembly.

At the bottom of the port plate, a track 130 may be attached, and a corresponding engaging structure can be provided on the damper assembly 10, so that the damper is precisely aligned upon installation, by the prior alignment of the track. Also, adjustment can be made if necessary to re-position the damper as needed. A further advantage of the device is that port plate 134 provides alignment and attachment points for the port cleaner is also usable to attach and align the damper device, or any other added equipment. Therefore, no further alignment procedures are required, or if any are, they are minimal.

An advantage provided by the structure of the present device is that sufficient spacing is provided below the body of the device such that even if material might build up and collect at the bottom of the wind box below the port (see reference 128 of FIG. 4), the louver frame is still able to stand back up from the lowered position, as sufficient clearance is provided below.

The device provides a fairly tight seal against the port, being held both by the force of air flowing through as well as by pneumatic cylinder 84 pushing the louver frame in tight against the port. The flanges 100 provide a sufficient seal to retard air from going around the louver structure. Being modular in structure, the apparatus is easily removed and installed while the recovery boiler is on-line. Repairs and inspection of the device need not await boiler shut down.

Preferably, suitable louver size and spacing is on a two to one ratio. For example, if a louver is constructed to be four inches long (length being the distance of the surface along which the air flow direction travels) then the louvers are suitably spaced to be two inches apart vertically. Other ratios may also be employed depending on the particular operational characteristics that are desired.

Other modifications are possible in alternative embodiments of the invention. For example, the damper can comprise plural damper plates, adapted to be manually placed and allowed to slide down tracks on the back of the louver frame. Varying size dampers may be provided, such that 1, 2, 4, 8, etc. louvers are covered by a given plate, and plural plates of different sizes may be employed to provide the desired amount of damping. In still another embodiment, referring to FIG. 4, a box 132 is provided such that when the damper assembly is retracted, it fits within the box, and a lid is closed on the top thereof. Now, the damper assembly is sealed off from the wind box, and it may be slid out like a drawer, for maintenance, while the air port is still being supplied with air. Accordingly, it is not required to shut an individual air port off while replacing the damper assembly.

Still further, in place of (or in addition to) the damper plates, the louvers may be suitably provided with the capability of being individually actuated so as to damp off and close a particular single opening in the louver frame. Other variations on the damper assembly include variable size and spacing of the louver openings, wherein to vary the flow amount, the louvers are moved further apart or closer together (with attendant size change of the overall opening). In embodiments using the louvers themselves to control flow, an individual lover is suitably split such that a portion of the louver will fold down and close off the opening. Yet another variation employs a velocity style plate at the back end of the louver frame, wherein the plate traverses up the louver frame, changing the angle of the plate to the horizon, and suitably sealing off more and more louvers as the plate rises. When the plate is essentially vertical all louvers are sealed, but when the plate is near a horizontal configuration, none of the louvers are sealed.

Other retraction mechanisms are also possible, for example, wherein the device swings to the side to get out of the way of a port cleaning apparatus. Also, while the preferred embodiment is pivoted at the bottom and swings down, in an alternative configuration, the louver frame swings up out of the way. Still further, the frame can slide back away from the port, while remaining substantially upright.

Figure 5:
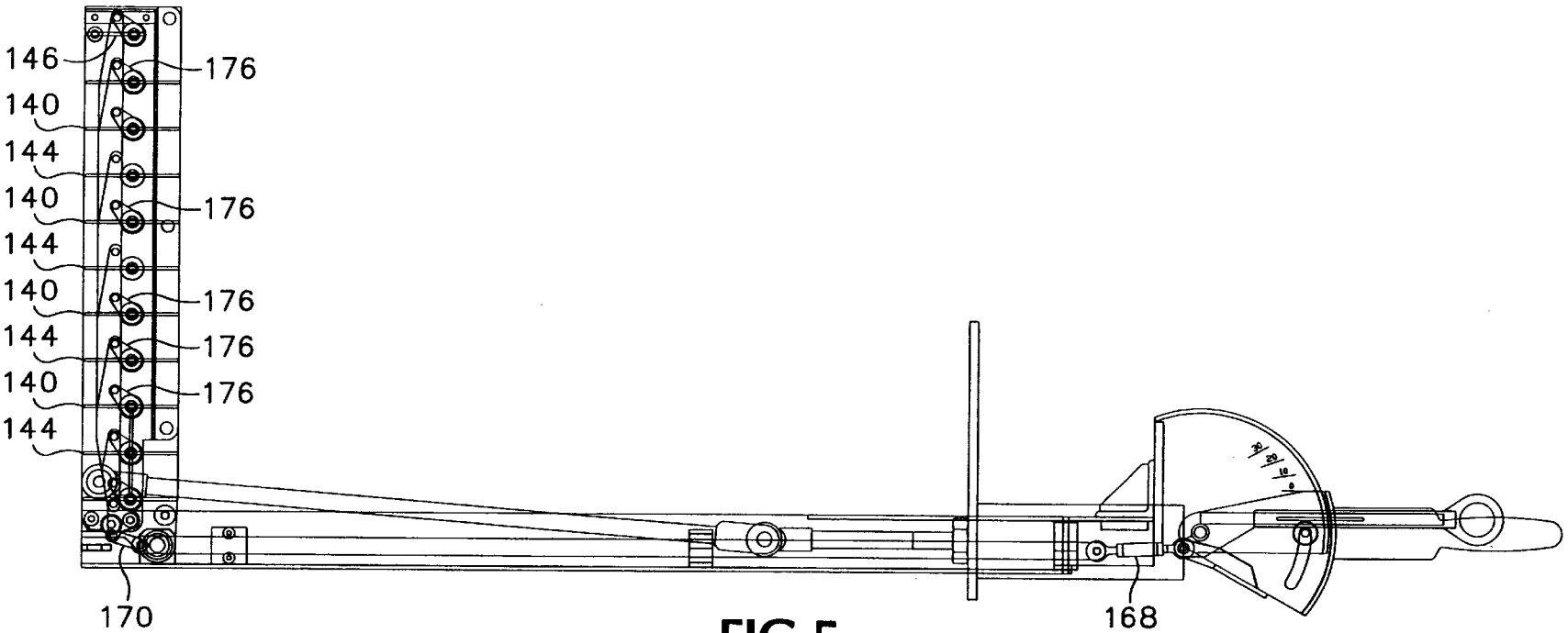
FIG. 5 is a side view of a preferred embodiment of the adjustable damper assembly.
Figure 6:
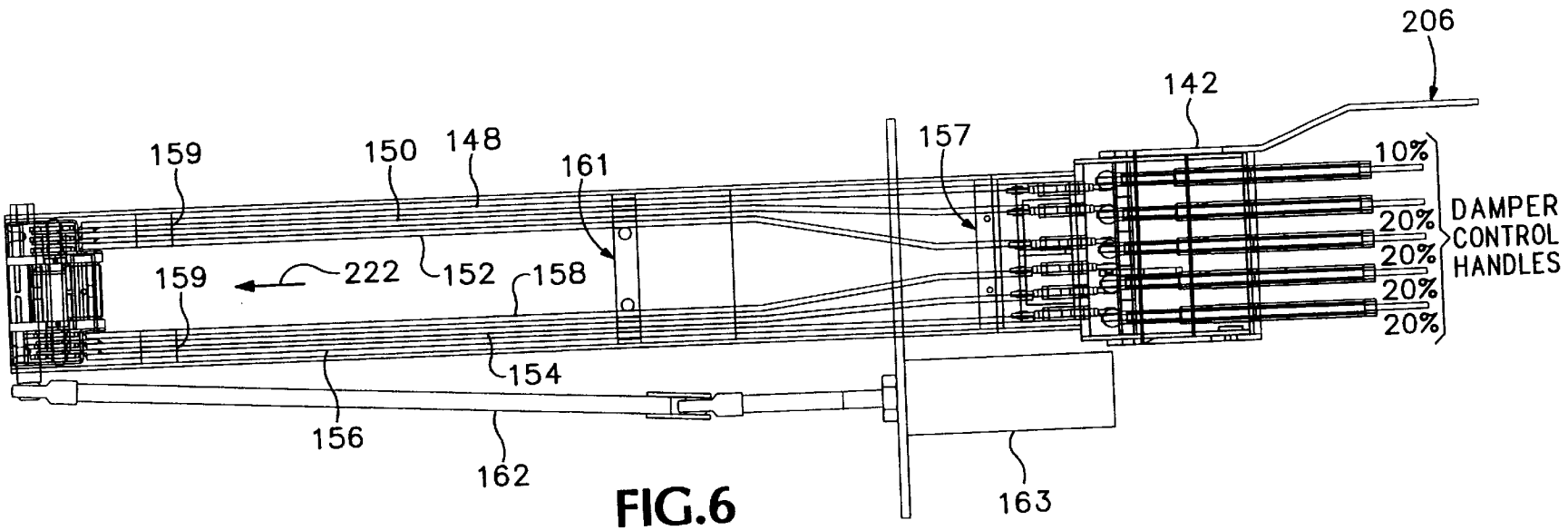
FIG. 6 is a top view of the damper assembly of FIG. 5.

FIG. 5 and FIG. 6 comprise side and top views of a preferred embodiment adjustable damper assembly. An object of the invention is to regulate the combustion air flow into a recovery boiler while also controlling the angle or direction of the air jet. Because of the construction of the boilers (vertical water filled tubes comprising the walls) the combustion air ports are elongated vertically. Therefore, the port height is divided into 10 increments or cells by the louvers 140, dampers 144 and top damper 146. The louvers and dampers are arranged (going from top to bottom) as top damper 146, louver 140, louver 140, damper 144, louver 140, damper 144, louver 140, damper 144, louver 140, damper 144. The dampers are controlled by individual push rods 148–156, which control the individual dampers (rod 148 controls top damper 146, rod 156 controls the bottom damper and the rods 150–154 control the respective middle dampers. A push rod 158 connects to the control handle semaphore 142 and controls the angle of adjustment of the louvers 140 in unison. Push rod guide block/air seal 157, guide block 161 and push rod bearings 159 guide and allow sliding movement of the push rods. The louvers are adapted to rotate in unison counter clockwise up to 30° off the horizontal axis of the device. When operating at 100% open, all of the louvers are parallel, and their angle is controlled by the angle of control handle semaphore 142. Five of the louvers, however, may be disengaged from the group to act as dampers to block a portion of the port to control the airflow into the boiler. To act as dampers, the five louvers may be rotated individually, as much as 90°. Because the louvers are twice as long as the spacing between them (1/10th port height), when one of the five louvers is rotated 90°, it blocks 20% of the port. The one exception is the top louver which is half as long as the others, and only blocks 10% of the port area when rotated 90°.

Each of the 5 independent louvers is controlled by a damper control handle. When the damper control handle for one of the 5 independent louvers is locked into the control handle semaphore, that lover is held in parallel relation to the other non-independent louvers. When the control handle semaphore is moved 0–30°, the non-independent louvers, and those louvers with their damper control handles locked into the control handle semaphore, likewise move 0–30°. The dampers rotate in unison with the louvers when their individual control handles are locked into the control handle semaphore. When the damper handles are rotated 90° counter clockwise and locked, the dampers are closed, one at a time. An air cylinder push rod 162 (driven by air cylinder 163) raises and lowers the louver/damper module 164. Turn buckles 168 connect the individual damper control handles to the control rods. An indicator plate 166 is provided, with markings thereon to indicate the angle of adjustment, so an operator can easily determine the degree of adjustment of the louvers.

If a damper control handle is not locked into the control handle semaphore, it is rotated and locked into the vertical position. This then rotates the associated louver (one of the 5 independent louvers) to the closed position, and holds it there, regardless of subsequent adjustment of the control handle semaphore.

The damper control handles are connected via a turnbuckle arrangement 168 (for adjustment) to a set of pushrods 148–156. Each damper control handle controls one louver. The control handle semaphore is similarly connected but controls up to six louvers in unison (non-independent louvers). The pushrods are connected via a swing link 170 to a bell crank 172. The bell crank is connected to the damper/louver links 174, which in turn act on torque arms 176, which turn the louvers. The swing link allows the louver module to rotate out of the way during a cleaning cycle so a cleaning head 175 can swing in and clean the port. The bell crank converts the horizontal motion of the push rods into vertical motion of the damper/louver links. There are six pushrods, six swing links, six bell cranks, and six damper/louver links. The torque arms also provide the pivot bearing for the louvers. Each louver has a torque arm on one end, and a bearing spindle on the other. The outside end of each torque arm and bearing spindle is supported by a cover, which also shields and protects the components from the harsh recovery boiler environment.

One feature of the device is that as the unit is retracted during a cleaning cycle (approximately every hour), the louvers are exercised (i.e., rotated) as much as 45° toward a middle position (45° from horizontal). This serves to keep the blades from sticking and sweeps the sides of the device of any excrescent material.

Another feature of the preferred embodiment is that the angle of the louvers and the damper settings are easily observable, even from a distance. The louver angle is equal to the angle of the control handle semaphore, and the damper setting is indicated by which damper control handles are rotated to the vertical position.

To control the amount of air entering the boiler, the dampers are closed in order 1–4 to close 20%, 40%, 60% or 80% of the port (damper 1 being the lowermost damper). Thus, the port is incrementally closed from the bottom up. This is advantageous for reasons already cited. The exception is the top damper 146 which may be closed by itself or in conjunction with any of the other dampers. Damper 146 is half as big as the others, therefore the port can be closed 10% to 90% in 10% increments. This arrangement minimizes the number of control elements required.

Another improvement of the preferred embodiment is the mounting of the louvers. The previous method (as in FIGS. 1–4) relies on relatively small tabs at each corner of the louvers. One end of the louvers is raised or lowered to change the louver angle. In this case, the louvers rotate about their centerline and engage the torque arms and bearing spindle via robust tabs on their centerline. In the event excess force is applied to the louvers, the preferred version is more likely to bend and absorb the force but stay in place. The FIGS. 1–4 version might also bend, but may tend to fall out as the engagement tabs come out of their holes.

A further advantage to the preferred version is that the mechanisms on the sides of the louver module are covered, which protects them from the recovery boiler environment.

Figure 7:
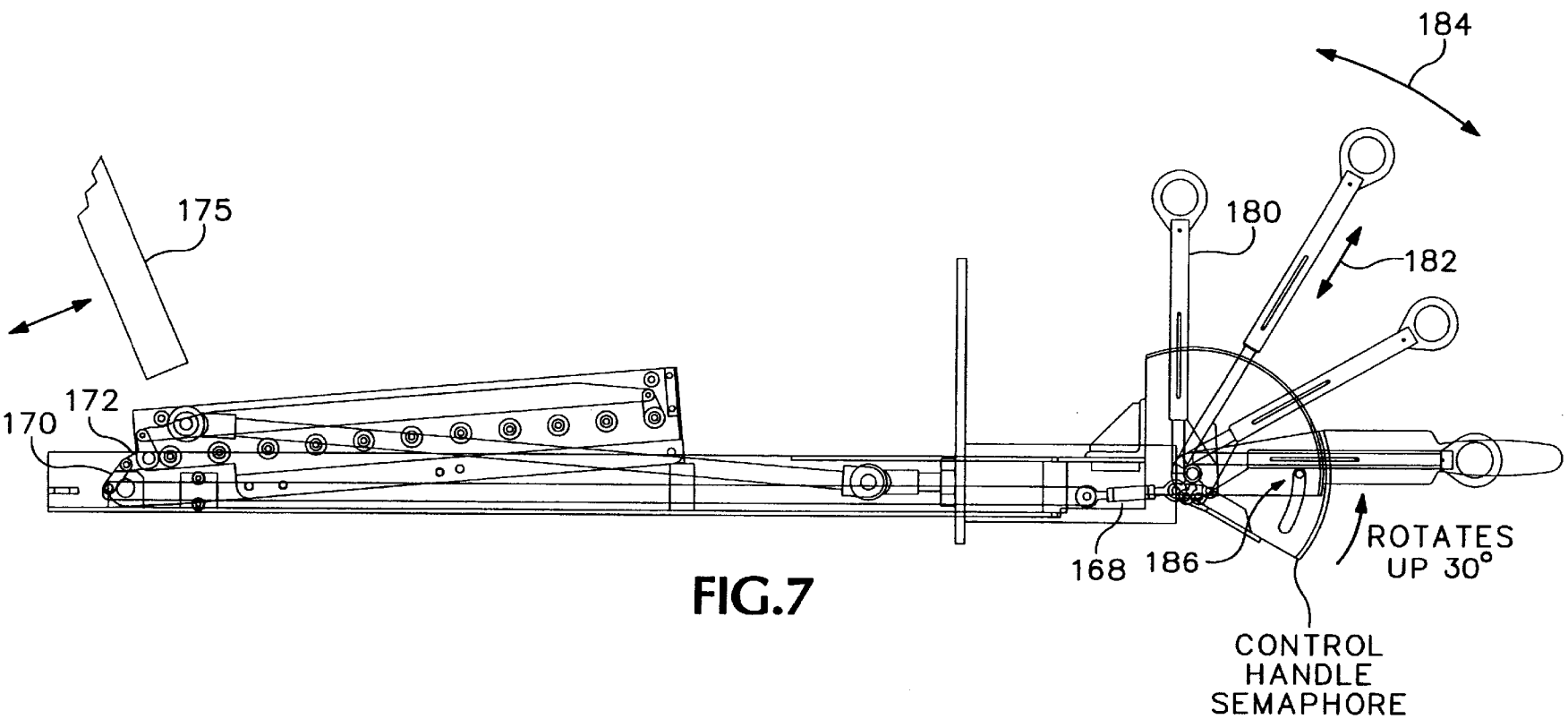
FIG. 7 is a side view of the damper assembly of FIG. 5 in the retracted position.

When the damper control handle is locked into the closed position (at 180 in FIG. 7) the handle indicates that the damper is closed (by its upright position). Handles in this position are disengaged from the control handle semaphore. The damper control handles are made in a telescoping arrangement, and are spring loaded to stay in the compressed orientation. By pulling the handle outwardly (see arrow 182) the handle is unlocked and is allowed to be rotated along arc 184, thereby adjusting the damper. A locking handle 186 locks the control handle semaphore (which controls the louvers) at the desired angle. When any or all of the damper control handles are locked into the control handle semaphore, those dampers connected to the damper control handles now act as louvers (and not as dampers). That is, they are held parallel to the other louvers, and their angle is adjusted in unison with the other louvers as the control handle semaphore is rotated.

Figure 9:
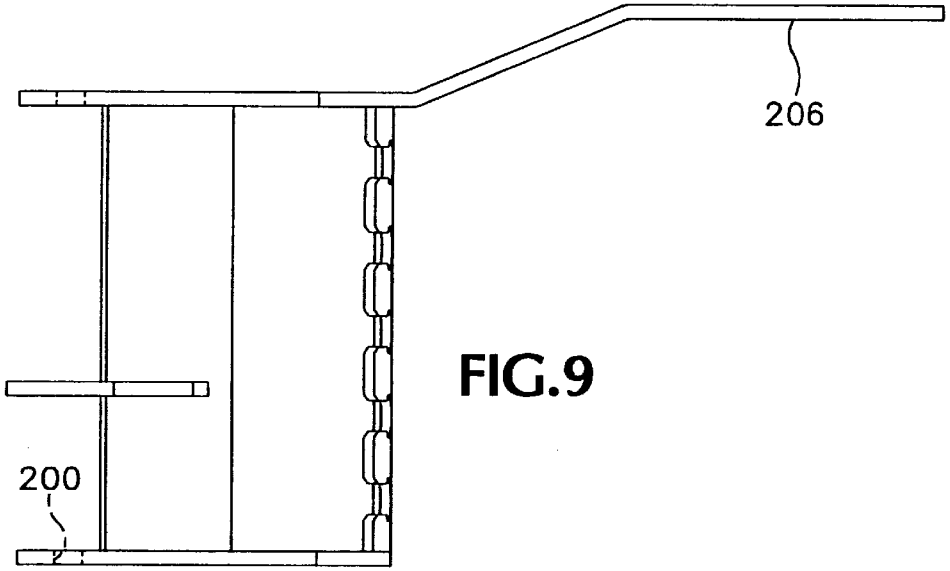
FIGS. 8–10 are views of components of the control handle semaphore.
Figure 10:
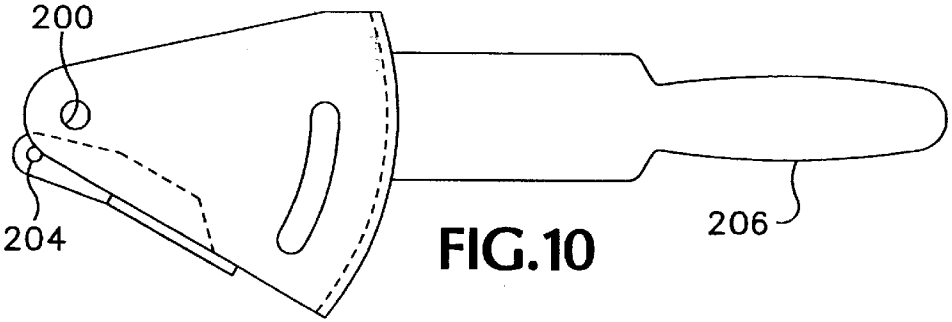
Figure 8:
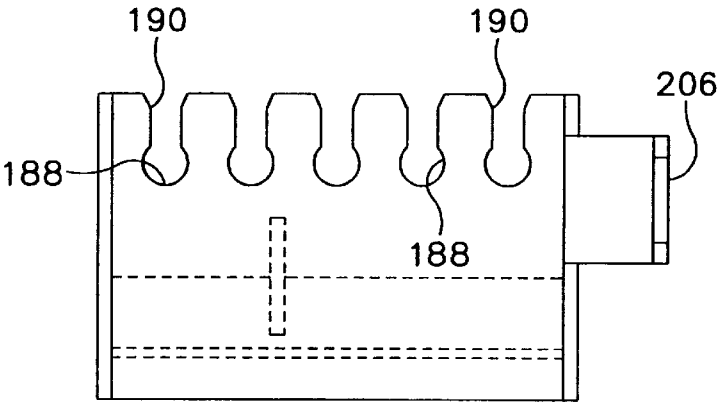
Figure 12:
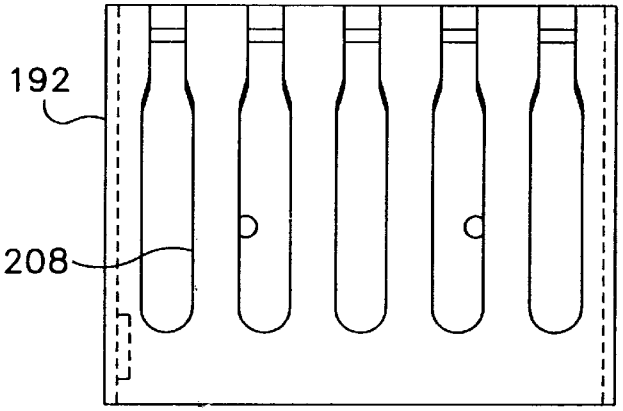
FIGS. 11–13 are views of components of the control handle quadrant.
Figure 11:
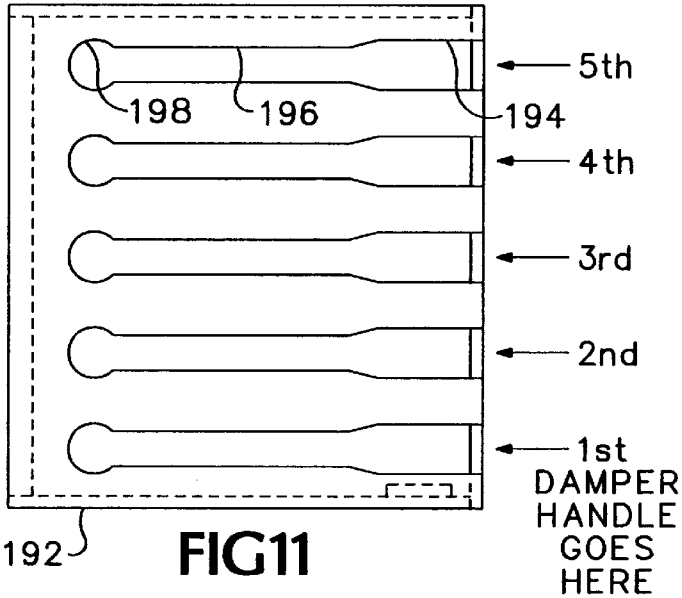
Figure 13:
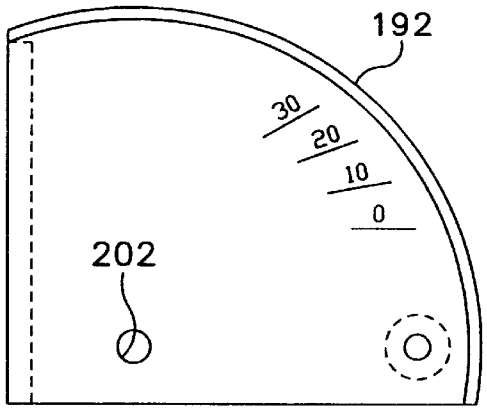

FIGS. 8–10 are views of components of the control handle semaphore, FIG. 8 being an end view from the direction of arrow 8 of FIG. 6, FIG. 9 being a top view and FIG. 10 being a side view. FIGS. 11–13 are top, end and side views respectively of components of the control handle quadrant.

Referring to FIGS. 8–13 together, the control handle semaphore comprises a body having plural holes 188 therein which open to slots 190. There are five such holes, for receiving the 5 control handles therein. The bodies of the control handles are telescoping and when compressed, an outer tube of the control handle will pass through hole 188 and lock the handle in position relative to the semaphore. To unlock the control handle, the handle is extended, which exposes a smaller diameter inner shaft which can then pass through slot 190, allowing the handle to disengage from the semaphore. The control handle quadrant 192 has 5 slots 194 therein with narrower portions 196 opening into holes 198. After the handles are disengaged from holes 188 and pass through slots 190, they are rotated through slots 196 and locked into holes 198 by returning the handles to the compress state. The larger outer portion of the handles pass through holes 198. The semaphore straddles the control handle quadrant when assembled, and pivots on a pin passing through holes 200, 202. The five independent control handles also rotate on the same pin. The louver push rod (and subsequently the louver link) is connected at hole 204 (FIG. 10). A handle member 206 is suitably provided on the semaphore, for manual movement of the semaphore by an operator.

Wider portions 208 of slots 194 in the control handle quadrant allow the control handles to rotate through a 30 degree arc while locked into the control handle semaphore.

Figure 14:
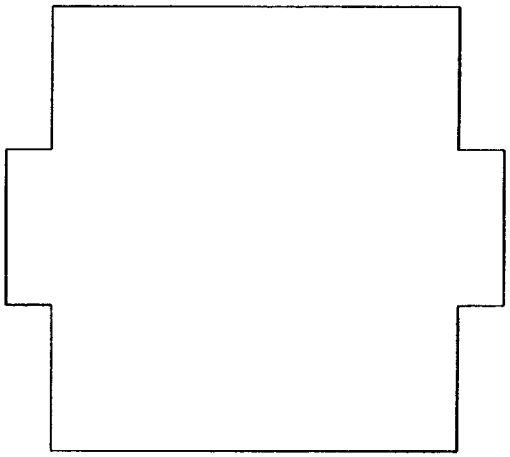
FIG. 14 is a top view of a typical louver.

FIG. 14 is a top view of a typical louver.

Figure 15:
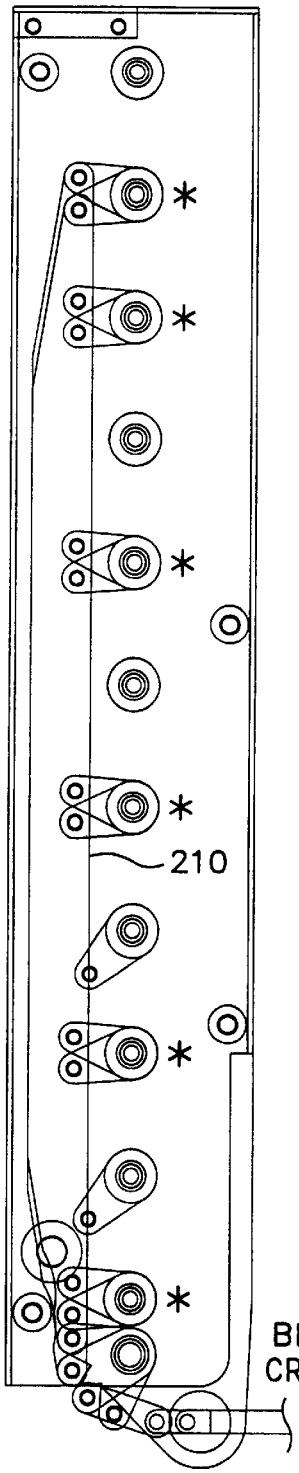
FIGS. 15–17 are views of left side components of the damper/louver frame assembly.
Figure 16:
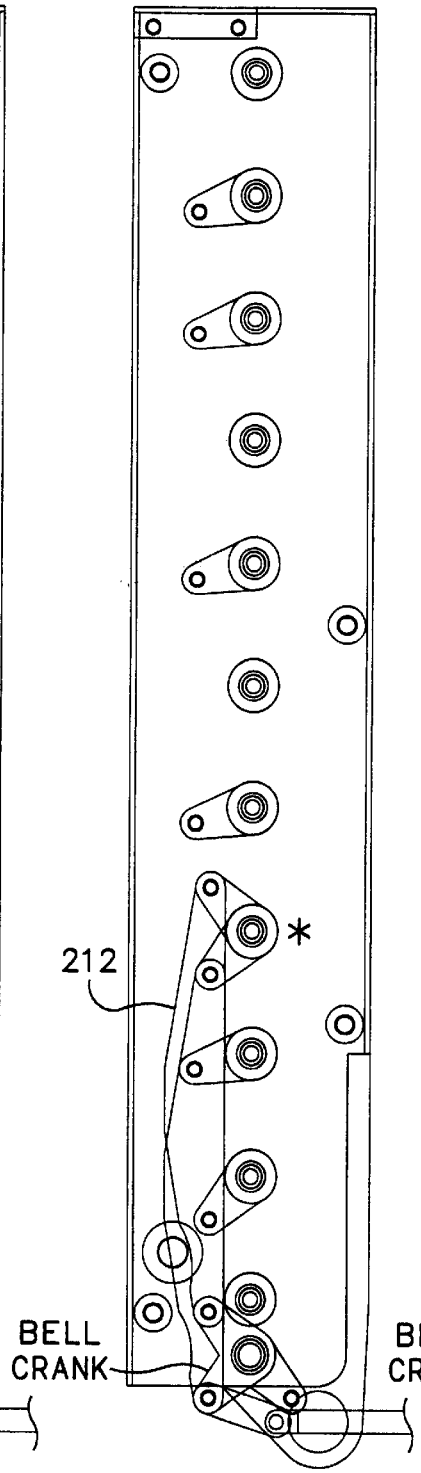
Figure 17:
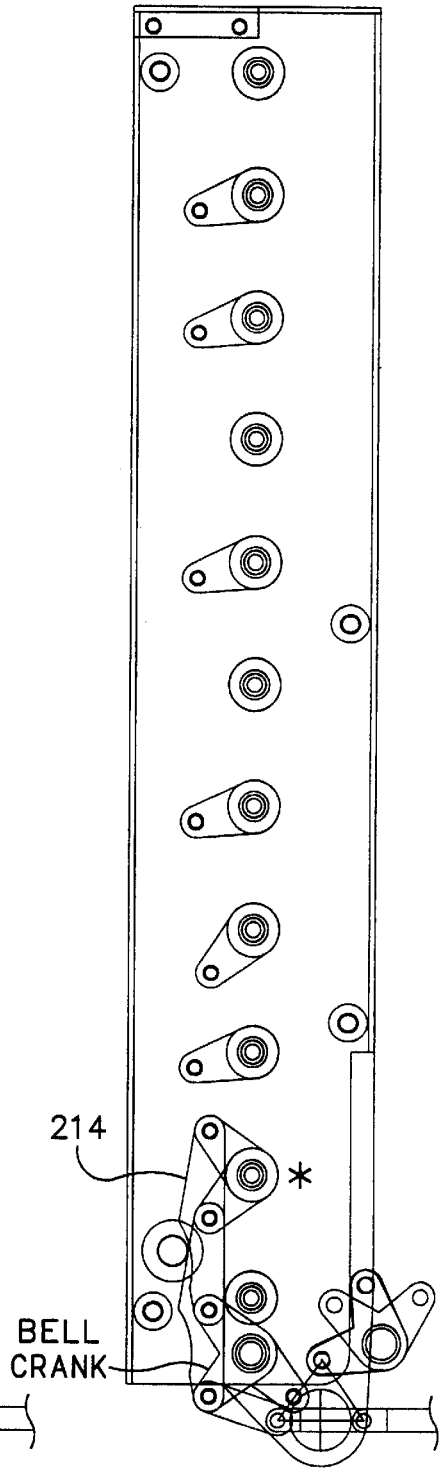

Referring now to FIGS. 15–17, which are views of left side components of the damper/louver structure, when assembled, the illustrated structures are stacked on top of one another, with FIG. 17 comprising the outermost assembly and FIG. 15 being the innermost. FIG. 15 illustrates a louver link 210 (showing 2 positions thereof), which is connected from the bell crank to six of the louvers (the connected louvers are marked with an asterisk (*)). The position of this link is controlled by the control handle semaphore. FIG. 16 shows a damper link 212 (again in two positions). The damper link 212 is connected to the bell crank and to damper number 2 (denoted by an asterisk in FIG. 16). This damper is controlled by the second damper handle. FIG. 17 shows the link 214 (two positions are shown) for the first damper (connected to the asterisk denoted damper). Link 214 connects the bell crank to the damper and is controlled by the first damper handle.

Figure 19:
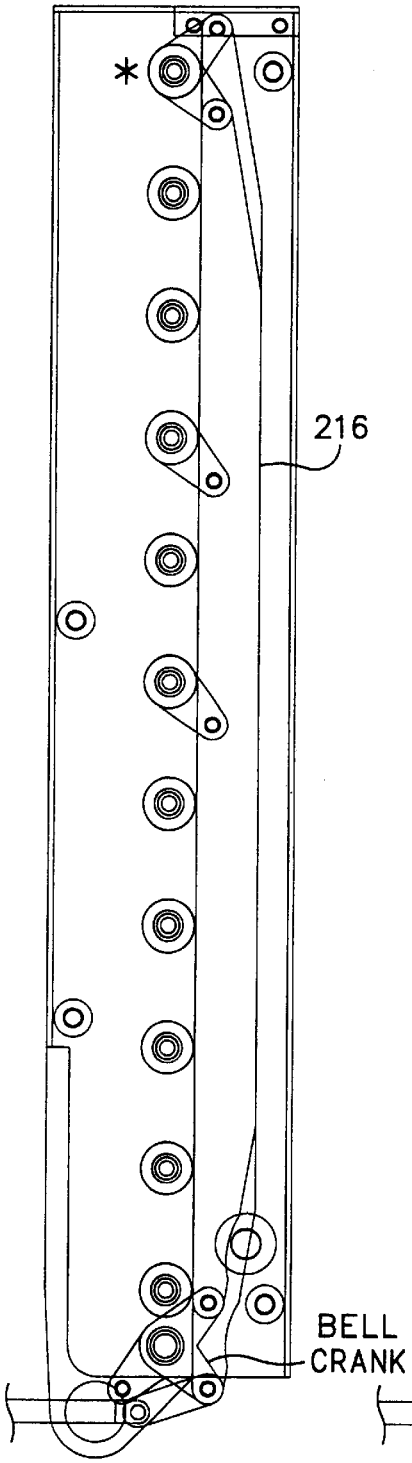
FIGS. 19–21 are views of right side components of the damper/louver frame assembly
Figure 20:
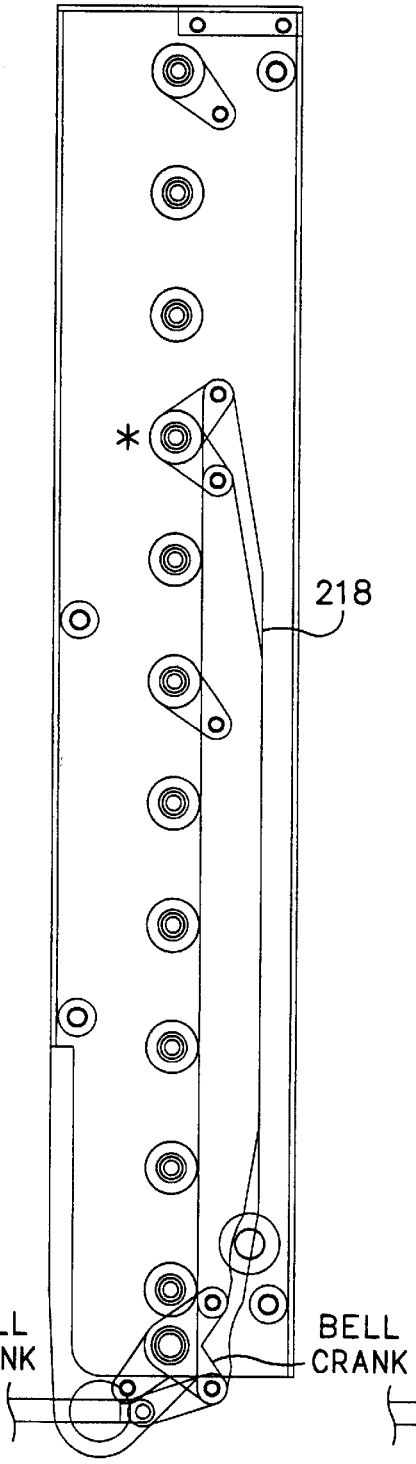
Figure 21:
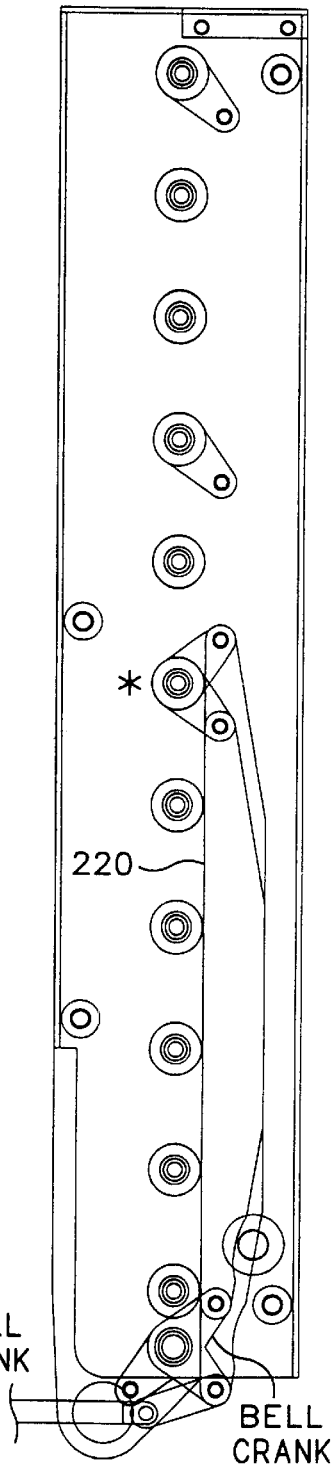

FIGS. 19–21 illustrate the right side components of the damper/louver structure. When assembled, the structures of FIGS. 19–21 are stacked on one another, with FIG. 19 being the outermost of the stack, and FIG. 21 being the innermost. FIG. 19 illustrates the fifth damper link 216 (in two positions). This link connects the bell crank to the fifth damper (denoted by an asterisk) and is controlled by the $5^{th}$ damper control handle. FIG. 20 illustrates the $4^{th}$ damper link 218 (shown in 2 positions). Damper link 218 connects the bell crank to the $4^{th}$ damper (denoted by an asterisk in FIG. 20) and is controller by the $4^{th}$ damper control handle. FIG. 21 illustrates the $3^{rd}$ damper link 220 (shown in 2 positions). Link 220 connects the bell crank to the third damper (*) and is controlled by the third damper control handle.

Figure 18:
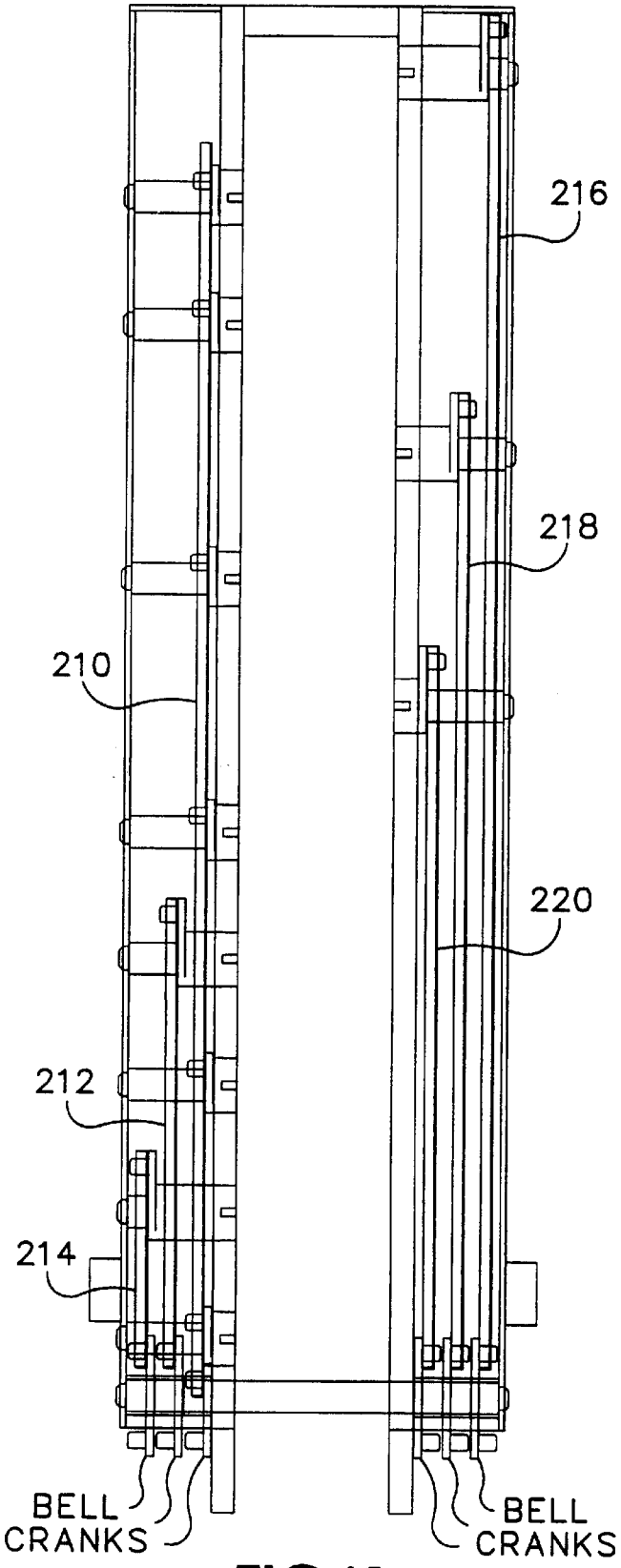
FIG. 18 is a view of the assembled damper/louver frame assembly taken in the direction of arrow 222 of FIG. 6.

FIG. 18 is a view taken in the direction of arrow 222 of FIG. 6, and illustrates the interrelation of the components of FIGS. 15–17 and 19–21 when assembled.

The embodiment according to FIGS. 5–21 provides a number of advantages over the embodiment of FIGS. 1–4. For example, the damper elements are regularly exercised during normal operation (suitably each cleaning cycle when the louver frame is retracted). Further, the settings of the damper controls and the louver angle are easily ascertained, since the control handles and semaphore clearly represent their respective settings. The device enables air damper control in 10% increments and is mechanically simpler, by using louvers as dampers, thereby reducing the number of elements that are being manipulated. The device settings can be adjusted while the in the upright and working position (rather than having to be retracted or withdrawn to make setting changes). The damper control handles are adapted to lock into one element, and unlock and then lock into another element.

Accordingly, an improved air port damper device is provided according to the invention. The device enables improved control of an individual air port, to enable fine tuning of furnace operation. The device is suitably adapted such that one size (especially one width) will work with a variety of port sizes. For example, an 8 inch wide damper assembly works well with port sizes of between 3 to 7 inch wide. An advantage to the invention is that it eliminates the need for a nozzle at the air port. Previously, fixed nozzles were employed to "shape" the air flow out of the air port. As the amount of room within a windbox is typically fixed, removing the need for a nozzle provides additional working room, making installation of the air port damper less complicated. Further, air flow characteristics within the windbox are improved, as nozzle and damper equipment in accordance with the prior art tended to take up substantial space in the windbox, making air flow characteristics in the wind box somewhat of an issue. In accordance with the invention, the overall length or depth of the device required to regulate air flow is reduced. Further, the invention essentially breaks the air port into plural smaller air ports, enabling control of the direction of the air jet in a short length. Inlet conditions into whatever duct work is present at the air port are improved, as the device of the present invention is compact, leaving lots of open room around the back top and sides, making installation and modification cheaper.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A recovery furnace combustion air regulator comprising:

a direction control unit for adjusting the direction of combustion air into a recovery furnace air port; and a damper control unit for adjusting the area over which combustion air is directed, wherein said damper control unit and said direction control unit are substantially adjacent one another or are coexistent with one another.

2. A recovery furnace combustion air regulator according to claim 1 further comprising a retraction device for removing said direction control unit away from the furnace air port for enabling automatic or manual cleaning of the air port.

3. A furnace combustion air regulator as in claim 1 wherein said direction control unit is located adjacent to the air port on an outside of the recovery furnace.

4. A furnace combustion air regulator as in claim 1 wherein said direction control unit is positioned inside a windbox.

5. A furnace combustion air regulator as in claim 1 wherein said direction control unit further comprises:

a frame defining an opening; and at least one louver mounted within said frame.

6. A furnace combustion air regulator as in claim 5 wherein said at least one louver is adapted to be adjustably angled to control a flow direction of air through said air port.

7. A furnace combustion air regulator as in claim 1 wherein said damper control unit comprises at least one damper member removably placeable in a path of air flow over said direction control unit for enabling adjustment of the flow of air into the furnace air port.

8. A furnace combustion air regulator as in claim 7 wherein said at least one damper has plural apertures defined therethrough for enabling continued partial flow of air through said damper when said damper is placed in the path of air flow.

9. A furnace combustion air regulator as in claim 7 wherein said at least one damper comprises a shield constructed from a synthetic resin polymer coated fiberglass and in movable relation to said direction control unit.

10. A furnace combustion air regulator as in claim 7 wherein said at least one damper comprises a shield constructed from a metal in movable relation to said direction control unit.

11. A furnace combustion air regulator as in claim 10 wherein said metal comprises stainless steel.

12. A furnace combustion air regulator as in claim 7 wherein said at least one damper comprises a metal mesh in movable relation to said direction control unit.

13. A furnace combustion air regulator as in claim 12 wherein said metal comprises stainless steel.

14. A furnace combustion air regulator as in claim 7 wherein said direction control unit comprises plural louver members in spaced relation and said at least one damper comprises a movable member adapted to be moved to block or to not block air flow over zero or more of said louvers.

15. A furnace combustion air regulator as in claim 14 wherein said damper is movable to sequentially block the flow of combustion air to zero or more adjacent louvers.

16. A furnace combustion air regulator as in claim 5 wherein said means for altering the adjustment direction comprises means for adjusting said at least one louver for altering a difference between an input air angle and an output air angle of air passing over said at least one louver.

17. A furnace combustion air regulator as in claim 1 wherein said direction control and damper control comprise at least one damper/louver element functional as both a damper and a louver.

18. A furnace combustion air regulator as in claim 1, wherein said furnace combustion air regulator is removable while the furnace is on line.

19. A furnace combustion air regulator as in claim 1, wherein movable portions of said direction control unit or said damper control unit are regularly exercised at periodic intervals.

20. A furnace combustion air regulator as in claim 19, wherein said movable portions of said direction control unit or said damper control unit are regularly exercised during an air port cleaning cycle.

21. A recovery furnace combustion air regulator according to claim 1, wherein said direction control unit comprises plural cells through with air passes and wherein said damper control unit selectively reduces or substantially closes off the air passing through at least one of said cells.

22. A recovery furnace combustion air regulator according to claim 1, wherein said recovery furnace combustion air regulator is a free standing and removable unit.

23. A recovery furnace combustion air regulator according to claim 1, wherein said air flow control unit is a free standing and removable unit.

24. A furnace combustion air regulator for adjusting the flow and direction of combustion air into a furnace air port comprising:

a retractable louver/damper unit that houses a plurality of adjustable louvers, and at least one adjustable damper for selectively blocking or not blocking an air flow path over at least one said louver;

an adjustment device for the adjustment of an angle of tilt on said louvers;

an adjustment device for controlling the selective blocking or not blocking of the air flow path through ones of said louvers; and a retraction device for the retraction of said louver/damper unit, wherein said adjustment device for controlling the selective blocking or not blocking of the air flow path is adapted for blocking the air flow path while substantially maintaining the mass flow of air through other than the ones of said louvers with blocked airflow paths.

25. A furnace combustion air regulator according to claim 24 wherein said retractable louver/damper unit is within a plenum, said retraction device comprises a sealing member for sealing the retracted louver/damper unit from the plenum when retracted, for enabling access thereto outside of said plenum.

* * * * *